United States Patent [19]

Bordes

[11] 4,069,785

[45] Jan. 24, 1978

[54] SHIP OF SIMILAR FLOATING INSTALLATION EQUIPPED FOR THE ASSEMBLY OF APPARATUS AND FOR LOWERING SAME INTO THE WATER

[75] Inventor: Cornelis Bordes, Maasland, Netherlands

[73] Assignee: N.V. Industrieele Handelscombinatie Holland, Rotterdam, Netherlands

[21] Appl. No.: 713,360

[22] Filed: Aug. 11, 1976

[30] Foreign Application Priority Data

Aug. 11, 1975 Netherlands ..... 7509546

[51] Int. Cl.[2] ..... B63C 1/02

[52] U.S. Cl. ..... 114/47; 114/258

[58] Field of Search ..... 114/44, 45, 47, 48, 114/65 R, 51, 264, 265, 258–260, 262; 61/64, 65; 175/7, 8; 166/.5

[56] References Cited

U.S. PATENT DOCUMENTS

| | | | |
|---|---|---|---|
| 2,287,434 | 6/1942 | Knudsen | 114/45 |
| 3,327,670 | 6/1967 | Burnett | 114/47 |
| 3,524,421 | 8/1970 | Schwendtner | 114/260 |
| 3,672,447 | 6/1972 | Kofahl | 175/7 |
| 3,894,640 | 7/1975 | Crooke et al. | 114/259 |

*Primary Examiner*—Trygve M. Blix
*Assistant Examiner*—Stuart M. Goldstein
*Attorney, Agent, or Firm*—Young & Thompson

[57] ABSTRACT

Ship or similar floating installation, equipped with a working deck, a lower intermediate deck and below this a bottom below water level. The intermediate deck is provided with spaces for the assembly of apparatus, which can be lowered through an opening. On the bottom and next to the opening the ship is provided with a dock with gates at the side of the opening and accessible from the intermediate deck, which gates can be opened and when closed allow the dock to be pumped dry.

2 Claims, 3 Drawing Figures

SHIP OF SIMILAR FLOATING INSTALLATION EQUIPPED FOR THE ASSEMBLY OF APPARATUS AND FOR LOWERING SAME INTO THE WATER

FIELD OF THE INVENTION

The invention relates to a ship or similar floating installation provided with a working deck, a lower situated intermediate deck and below this a bottom below water level. This intermediate deck is provided with spaces for the assembly of apparatus which can be lowered through an opening. This type of ship is known as a drill ship. In this case it is customary to assemble and to test the apparatus, such as a blow-out seal, on the intermediate deck. As long as the apparatus, for example a blow-out preventor, is of moderate size and allows the assembly and the testing to be carried out within the restricted height between the working deck and the intermediate deck, no special problems will arise.

BACKGROUND OF THE INVENTION

However, where the apparatus to be assembled becomes too large for this space, problems do arise. Of course, the height between the working deck and the intermediate deck can be increased, though this will be at the expense of the stability of the ship. It is known that to solve this problem a blow-out preventor for example, is assembled in two separate parts, then the two parts moved to the centre above the opening, coupling them up, testing and then lowering through the opening. These operations are very time consuming and meanwhile no further drilling can be done. Furthermore, the working deck has to be constructed in such a way as to allow the turntable to be removed, to enable the top part of the blow-out preventor to protrude through.

It is also known to provide the working deck with a slot. The blow-out preventor, assembled and tested, located on the intermediate deck, protrudes upwards through this slot and has to be moved sideways in order to bring it above the opening. This cuts down the loss of time, but the working deck has to be fitted with removable parts and consequently becomes complicated and expensive.

SUMMARY OF THE INVENTION

The purpose of the invention is to construct a ship in such a way that apparatus like large blow-out preventors can be assembled and tested without causing great loss of time during other operations, and without necessitating radical alterations in the design of the working deck.

According to the invention this aim is achieved by providing the ship with a dock and gates on the bottom and next to the opening, the gates being able to open to the side of the opening and the dock being accessible from the intermediate deck. According to the invention, therefore, the floor where the work on the apparatus is carried out is moved to a lower level, the bottom, for example, and this section is closed towards the opening by means of gates. In this way a dock is created, the bottom of which is below wate level. The intermediate deck can be utilised in the usual way for assembling the parts of the apparatus. These can be assembled and tested in the dock when dry and thereupon the dock can be filled and the apparatus lowered through the open gates of the dock above the opening. The free height required above the deck for these operations is now restricted and the low setting of the often heavy apparatus has a favourable influence on the stability of the ship.

There is hardly any need to interrupt other operations and if the dock is large enough further units assembled and tested can be stored.

With increased size of apparatus, such as large and heavy blow-out seals, it becomes all the more difficult to control the movements caused by the roll of the ship.

A further advantage of the invention is that the apparatus on removal from the dock to the opening is suspended in the water, thus reducing the roll. This enables the apparatus to be lowered under fairly bad weather conditions.

BRIEF DESCRIPTION OF THE DRAWINGS

The invention is explained further by the drawings.

DETAILED DESCRIPTION OF THE INVENTION

Figure 1:
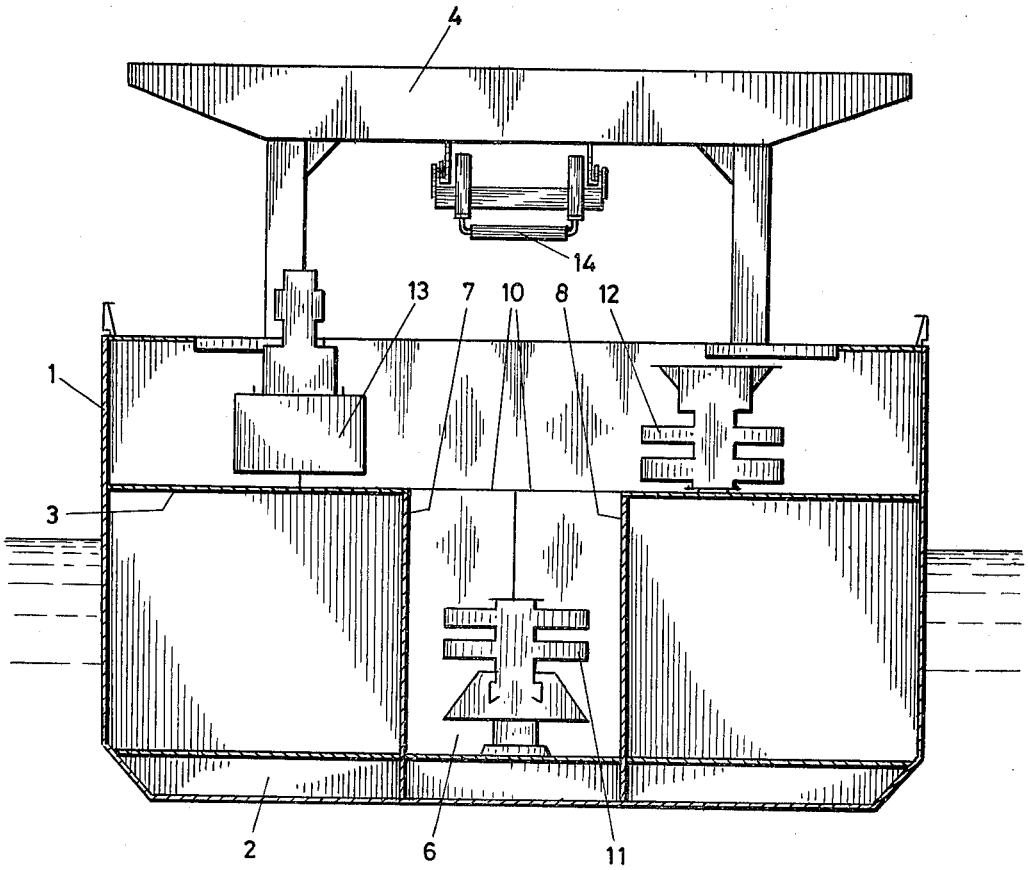
FIG. 1 is a cross section through a part of a ship, namely through the longitudinal axis of the ship, according to line I—I of FIG. 3.

The drawings show a hull 1, with bottom 2 and an intermediate deck 3, with the hull carrying a working deck 4.

The bottom has an opening 5.

On the bottom 2 and next to opening 5 there is the compartment 6 with vertical walls 7, 8 and 9 and having sluice gates 10.

Figure 2:
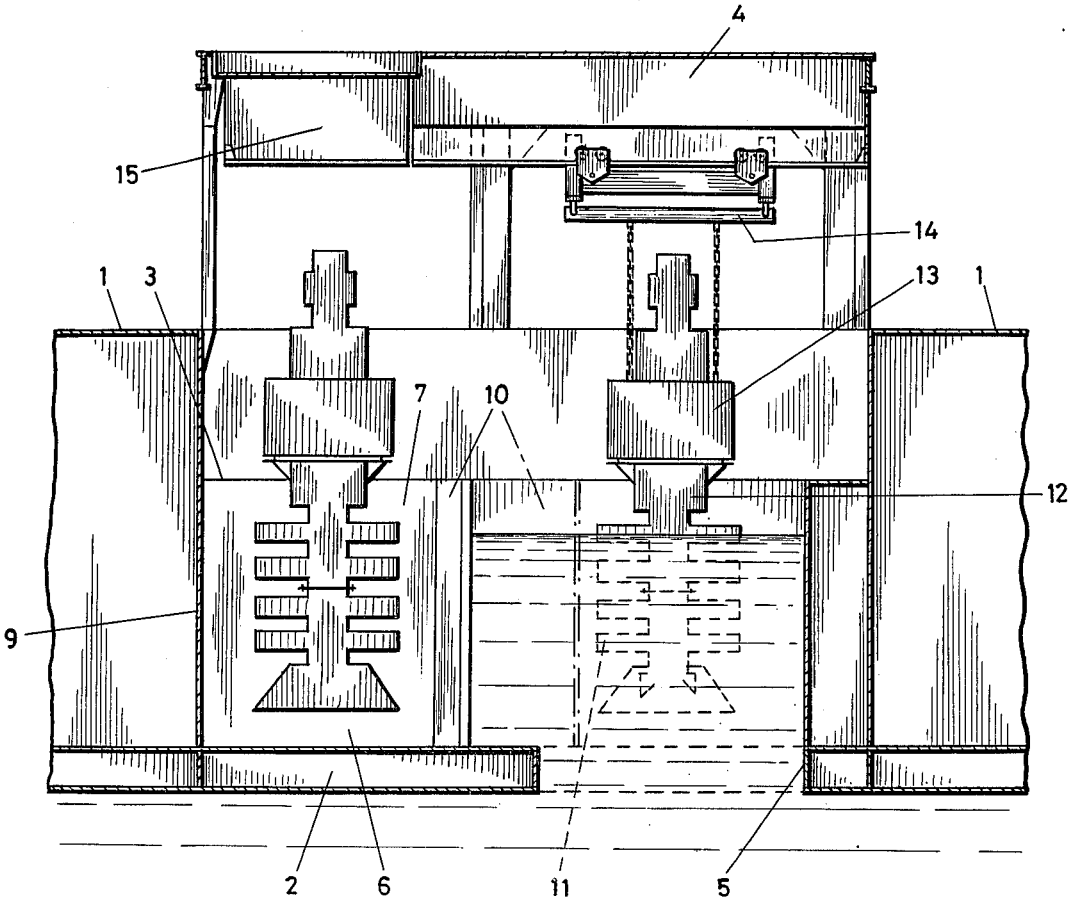
FIG. 2 is a section according to line II—II of FIG. 3.
Figure 3:
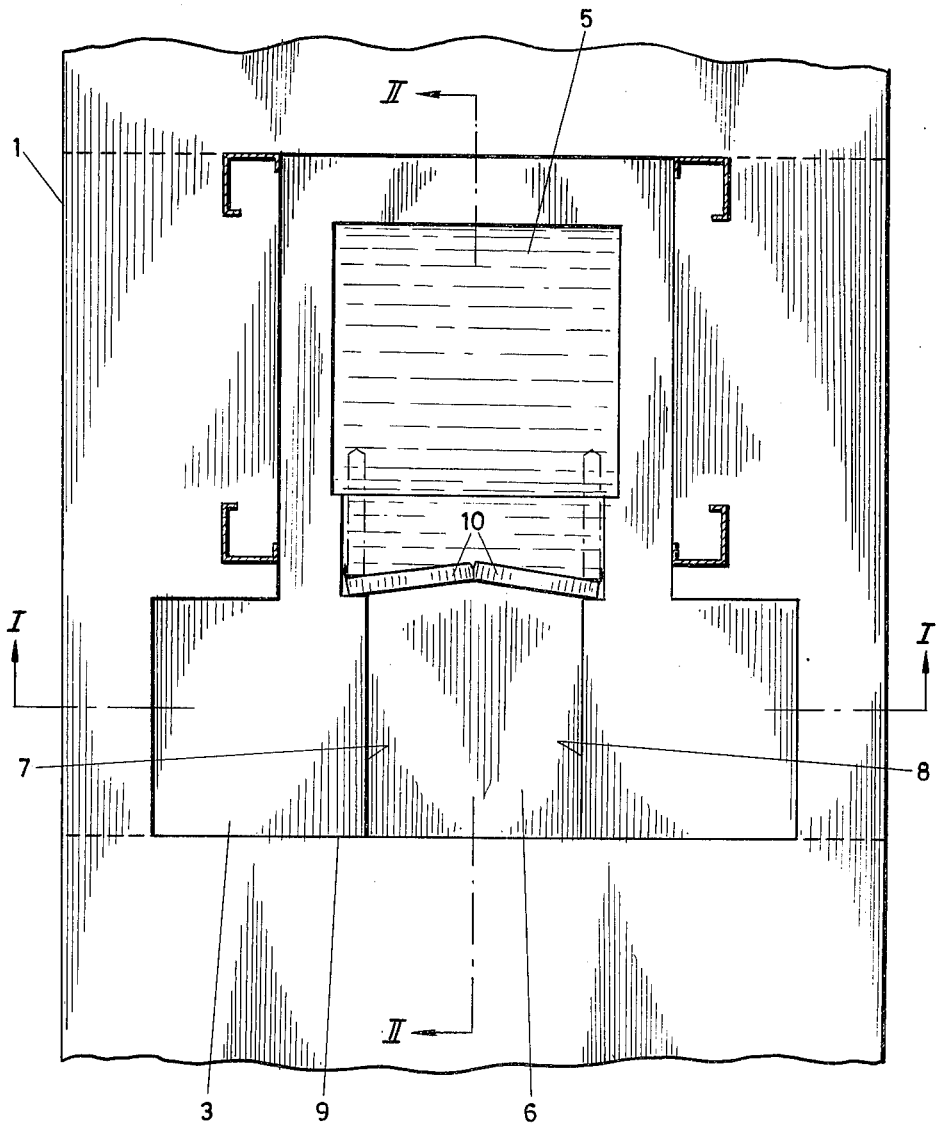
FIG. 3 is a view from above.

In the closed position, as shown in FIG. 3, the water in the compartment within the walls 7 to 10 inclusive can be evacuated and the assembly of the apparatus, for example parts 11, 12 and 13 of the blow-out preventor, can take place on the bottom in the dock. FIG. 1 shows the bottom section 11 seated on the dock bottom, the centre section 12 on the intermediate deck 3 and the top section 13 on another part of the intermediate deck 3. These sections can be assembled with the aid of handling equipment, such as a lifting crane. For this purpose, part of the transporter rail 15 is made removable. After completion of these operations the sluice gates 10 can be opened and the assembly, as shown in FIG. 2, moved from the dock over the opening 5 by means of handling equipment, such as the travelling crane 14, and then be lowered.

We have chosen a blow-out preventor as an example of the apparatus to be assembled. However, the principle could apply equally well to diving apparatus, pipeline repair equipment, submerged well-seals many others.

The opening need not be in the middle of the hull. It is quite possible to arrange for the doors to be opened at one side of the ship so that the apparatus can be lowered alongside the ship.

Of course, pump means (not shown) are provided for evacuating water from compartment 6; and valve means (not shown) are provided for readmitting water to compartment 6 to facilitate the opening of gates 10.

What is claimed is:

1. A ship for the storage, assemblage and movement of underwater apparatus comprising a floating hull provided with a bottom, said bottom having an opening therein for the movement of said underwater apparatus;

an intermediate deck in said hull above the bottom, said intermediate deck having an opening therein in vertical alignment with the opening in the hull and of an area greater than the opening in the bottom so as to overlie a portion of the bottom adjacent the opening in the bottom;

walls forming a dock compartment on said portion of the bottom adjacent the opening in the bottom and beneath the opeining in the intermediate deck;

gates between the dock compartment and space above the opening in the bottom for closing communication between the dock compartment and the space above the opening in the bottom and for providing access between said compartment and said space over the opening in said bottom for the movement of apparatus from the dock compartment to said space above the opening in the bottom, and a working deck carried by said ship above the intermediate deck.

2. A ship according to claim 1 wherein means is carried by the working deck for moving apparatus from the dock compartment to the space above the opening in the bottom when the gates are open.

* * * * *